US007469980B2

(12) United States Patent
Koo

(10) Patent No.: US 7,469,980 B2
(45) Date of Patent: Dec. 30, 2008

(54) DOOR BASKET OF REFRIGERATOR

(75) Inventor: Min Bon Koo, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/798,846

(22) Filed: May 17, 2007

(65) Prior Publication Data

US 2007/0267952 A1 Nov. 22, 2007

(30) Foreign Application Priority Data

May 18, 2006 (KR) ..... 10-2006-0044847

(51) Int. Cl.
*A47B 96/16* (2006.01)

(52) U.S. Cl. ..... 312/405.1; 312/321.5

(58) Field of Classification Search ..... 312/401, 312/405, 405.1, 408, 321.5, 298, 300; 62/377
See application file for complete search history.

(56) References Cited

U.S. PATENT DOCUMENTS 5,685,624 A * 11/1997 Lee ..... 312/405.1
2003/0020386 A1* 1/2003 Leimkuehler et al. .... 312/405.1
2004/0178711 A1* 9/2004 Avendano ..... 312/405.1
2005/0073227 A1* 4/2005 Shin ..... 312/404

FOREIGN PATENT DOCUMENTS

WO WO 2006/032641 * 3/2006

* cited by examiner

*Primary Examiner*—James O Hansen
(74) *Attorney, Agent, or Firm*—KED & Associates, LLP

(57) ABSTRACT

A door basket of a refrigerator is disclosed. The door basket includes a supporting basket detachably installed to a rear surface of a door of the refrigerator, extending in the form of a rectangular hexahedral shape in the longitudinal direction, and having a seating space with an open upper side and a longitudinal open side; and a pivoting basket optionally seating in the seating space by which an opposite end of the pivoting basket is supported to pivot forward and backward the door about an end of the pivoting basket, extending in the form of a rectangular hexahedral shape in the longitudinal direction to correspond to the seating space, and having an accommodating space with an open upper side to accommodate food. It is possible to minimize restriction of height of food to be accommodated in the door basket and to easily accommodate food.

25 Claims, 4 Drawing Sheets

DOOR BASKET OF REFRIGERATOR

BACKGROUND OF THE INVENTION

1. Field

This relates to a refrigerator, and more particularly, to a door basket of a refrigerator installed to a rear side of a door of the refrigerator to accommodate food.

2. Background

FIG. 1 illustrates a door of a refrigerator in which a conventional door basket of a refrigerator is installed.

As illustrated, protrusions 13 extend on lateral sides of the rear surface of a door 10 of the refrigerator in the vertical direction. The protrusions 13 are formed by which a part of a door liner 11 to form a rear appearance of the door 10 protrudes backward by a predetermined height. On the rear surface of the door 10, between the protrusions 13, a plurality of supporting steps 15 extends in the lateral direction. Like the protrusions 13, the supporting steps 15 are formed by which a part of the door liner 11 protrudes backward by a predetermined height (equal to or lower than that of the protrusions 13).

On the rear surface of the door 10, a plurality of door baskets 20 is detachably installed. The door baskets 20 are installed on the rear surface of the door 10 to be spaced apart from each other by a predetermined distance in the vertical direction. Each of the door baskets 20 has an open-topped rectangular hexahedral shape and extends in the lateral direction.

Each of the door baskets 20 has an accommodating space 20*s* to accommodate food therein. The accommodating space 20*s* has an open-topped rectangular hexahedral shape corresponding to the shape of the door baskets 20.

On the other hand, the lateral sides of the door baskets 20 closely contact the inner surfaces of the protrusions 13. The lower sides of the door baskets 20 are supported by the upper sides of the supporting steps 15. Although not depicted in the drawings, the inner sides of the protrusions 13 and the respective lateral sides of the door baskets 20 include fixing protrusions and fixing recesses to mount the door baskets 20 to the rear surface of the door 10.

However, the conventional door basket of a refrigerator has the following drawbacks.

As described above, since the accommodating space 20*s* has the open-topped rectangular hexahedral shape, food can be inserted downward from the above into the accommodating space 20*s*. Thus, the top of the food to be accommodated in and taken out one accommodating space 20*s* must be spaced apart from the lower side of another door basket 20 positioned directly upper the former by a distance corresponding to the height of the accommodating space 20*s*. In other words, the height of the food to be accommodated in the accommodating space 20*s* is restricted by a distance in which the height of the accommodating space 20*s* subtracts from a distance between the door basket 20 and another door basket 20 positioned directly above the former.

Moreover, in order to prevent the food to be accommodated in and to be taken out from being disturbed by the front top of the door basket 20 and the lower side of another door basket 20 positioned directly above the former, food must be inclined at an angle when food is accommodated in the accommodating space 20*s* or food accommodated in the accommodating space 20*s* is taken out. Thus, the accommodation and the taking-out of food in and from the accommodating space 20*s* of the door basket 20 is troublesome.

SUMMARY

Accordingly, the embodiments broadly described herein solve the above-mentioned problems. An object is to provide a door basket of a refrigerator to efficiently accommodate food.

Another object is to provide a door basket of a refrigerator in which food can be easily accommodated or taken out.

In order to accomplish these objects, there is provided a door basket of a refrigerator including: a supporting basket detachably installed to a rear surface of a door of the refrigerator, extending in the form of a rectangular hexahedral shape in the longitudinal direction, and having a seating space with an open upper side and a longitudinal open side; and a pivoting basket optionally seating in the seating space by which an opposite end of the pivoting basket is supported to pivot forward and backward the door about an end of the pivoting basket, extending in the form of a rectangular hexahedral shape in the longitudinal direction to correspond to the seating space, and having an accommodating space with an open upper side to accommodate food.

The supporting basket includes an upper flange extending outwardly from an upper side of the supporting basket and a hinge hole formed in the upper side of the upper flange; and the pivoting basket includes an upper flange extending outwardly from the upper side of the pivoting basket and a hinge pin formed in the lower side of the upper flange of the pivoting basket to correspond to the hinge hole such that the hinge pin is pivotally inserted into the hinge hole and the pivoting basket pivots forward and backward the door about the hinge pin with respect to the supporting basket.

The door basket further includes a supporting device to prevent the pivoting basket from being freely separated from the supporting basket during the pivoting of the pivoting basket.

The supporting device includes: a hinge bracket extending outwardly from the upper flange of the pivoting basket and including a hinge pin formed in the lower side thereof; and a supporting rib provided at the upper side of the upper flange of the supporting basket to support the hinge bracket during the pivoting of the pivoting basket.

The supporting rib includes: a protrusion protruding upwardly from the upper side of the upper flange of the supporting basket adjacent to a track generated by the hinge bracket due to the pivoting of the pivoting basket; and a support extending into the track generated by the hinge bracket from the upper side of the protrusion to closely contact the upper side of the hinge bracket.

The door basket further includes a penetrated cut-off part provided at a side of the hinge bracket to allow the supporting rib to pass in the vertical direction while the hinge pin is inserted into the hinge hole.

The pivoting basket pivots within a range from 0 degree to 180 degrees forward and backward the door about the hinge pin from the state where the pivoting basket seats in the seating space, and the penetrated cut-off part is positioned to correspond to the supporting rib when the pivoting basket pivots by 180 degrees from the state where the pivoting basket seats in the seating space.

The door basket further includes a locking device to prevent the pivoting basket from freely pivoting from the state where the pivoting basket seats in the seating space.

The locking device includes: a locking hole formed in the upper side of an upper flange extending outwardly from an opposite upper side of the supporting basket corresponding to an opposite side of the hinge hole; and a locking protrusion provided in the lower side of the upper flange extending outwardly from an opposite upper side corresponding to an opposite side of the hinge pin, and inserted into the locking hole when the pivoting basket seats in the seating space.

The locking device further includes a locking rib provided on the upper side of the supporting basket in which the locking hole is formed such that an outer end of the upper flange of the pivoting basket having the locking protrusion optionally and closely contacts the locking rib when the pivoting basket seats in the seating space.

As described above, according to the present invention, the restriction for the height of food to be accommodated in the accommodating space of the door basket can be minimized and food can be easily accommodated in and taken out of the accommodating space.

BRIEF DESCRIPTION OF THE DRAWINGS

The above and other objects, features and advantages of the embodiments as broadly described herein will become more apparent from the following detailed description taken in conjunction with the drawings, in which.

DETAILED DESCRIPTION

Hereinafter, an exemplary embodiment of the present invention will be described with reference to the accompanying drawings.

Figure 1:
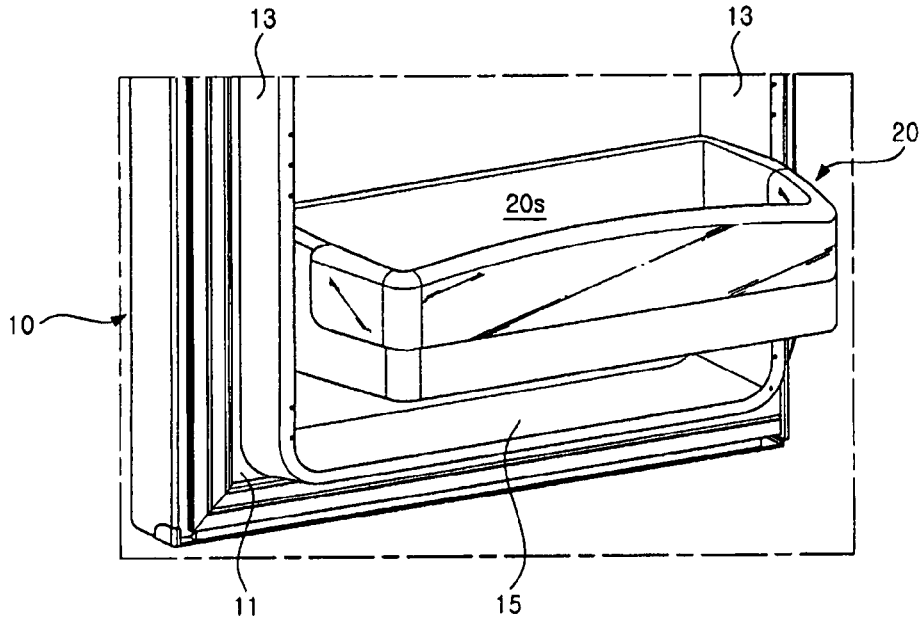
FIG. 1 is a view illustrating a door of a refrigerator in which a conventional door basket of a refrigerator is installed.
Figure 2:
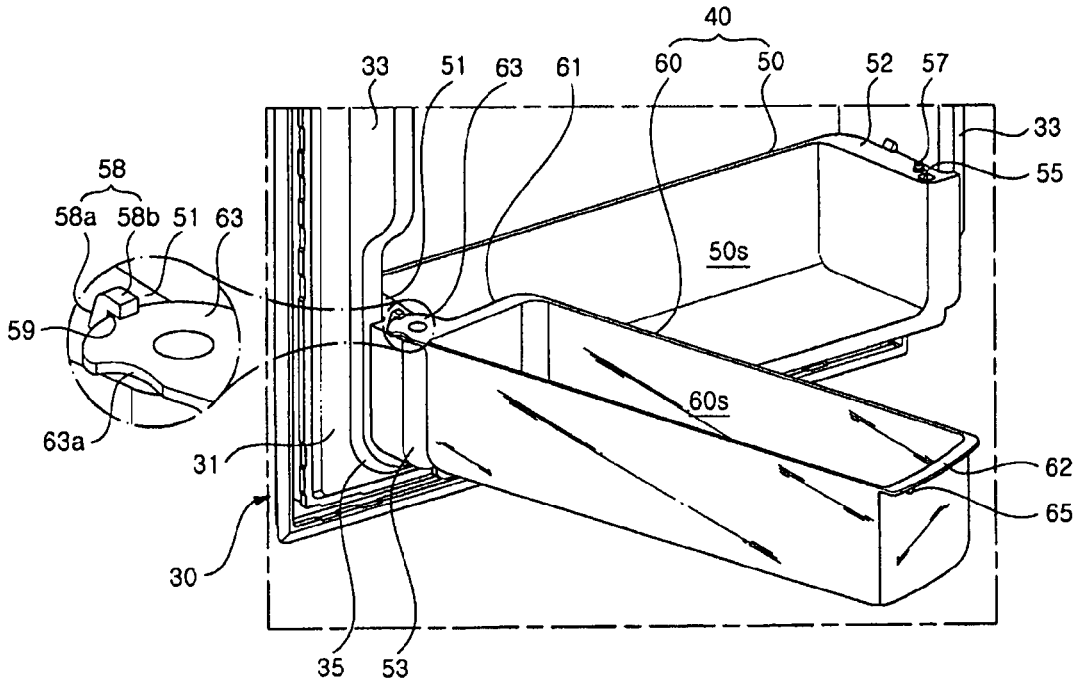
FIG. 2 is a view illustrating a door basket of a refrigerator according to an embodiment of the present invention.

FIG. 2 is a view illustrating a door basket of a refrigerator according to an embodiment of the present invention.

As illustrated, a door liner 31 forms a rear appearance of a door 30 of a refrigerator. At the rear lateral sides of the door 30, a pair of protrusions 33 is provided, and a plurality of supporting steps 35 are provided in the rear surface of the door 30 corresponding to a space between the protrusions 33. The protrusions 33 and the supporting steps 35 are formed by which a part of the door liner 31 protrude backward.

On the rear surface of the door 30, a plurality of door baskets 40 is detachably installed. The door baskets 40 are installed on the rear surface of the door 30 to be spaced apart from each other by a predetermined distance in the vertical direction. Each of the door baskets 40 includes a supporting basket 50 detachably installed on the rear surface of the door 30 and a pivoting basket 60 pivotally supported by the supporting basket 50 to pivot in the forward and backward direction of the door 30.

Each of the supporting baskets 50 has a rectangular hexahedral shape and extends in the longitudinal direction. Substantially, longitudinal sides of the supporting baskets 50 closely contact the rear surface of the door 30. The respective lateral sides of the supporting baskets 50 closely contact surfaces of the protrusions 33 to face each other, and the lower sides of the supporting baskets 50 are supported by the upper sides of the supporting steps 35.

Although not depicted in the drawings, the protrusions 33 include fixing protrusions formed in surfaces thereof to face each other and the supporting baskets 50 include fixing recesses formed in lateral sides thereof. When the fixing protrusions are inserted into the fixing recesses, the supporting baskets 50 are mounted to the rear surface of the door 30 and are not separated therefrom freely.

Moreover, each of the supporting baskets 50 has a seating space 50*s*. The pivoting baskets 60 are seated on the seating spaces 50*s*. Each of the seating spaces 50*s* has an open upper side and an open longitudinal side.

Moreover, each of the supporting baskets 50 includes upper flanges 51 and 52 formed on the lateral upper sides adjacent to the open longitudinal side of the supporting basket 50. The upper flanges 51 and 52 of the supporting basket 50 extend from the lateral upper sides thereof to the exterior. For the illustrative convenience, one of the upper flanges 51 and 52 of the supporting basket 50 seen left side in the drawings is referred to as a left flange 51, and the other seen right side in the drawings is referred to as a right flange 52.

Each of the supporting baskets 50 includes a hinge boss 53 formed in a leading edge of each of the left flanges 51. The hinge bosses 53 extend in the leading edges of the left flanges 51 in the vertical direction, respectively. Each of the hinge bosses 53 is provided with a hinge hole 54 (See FIG. 3). The hinge holes 54 extend in the longitudinal direction of the hinge bosses 53 and have open upper sides.

Moreover, the supporting baskets 50 have locking holes 55 formed in the leading edges of the right flanges 52, ie., in the opposite sides of the hinge bosses 53. The locking holes 55 are formed by which parts of the leading edges of the right flanges 52 of the supporting baskets 50 are depressed downward. Locking protrusions 65 described later are inserted into the locking holes 55 when the pivoting baskets 60 are seated in the seating spaces 50*s*.

Moreover, the supporting baskets 50 include locking ribs 57 formed in the upper sides of the right flanges 52. The locking ribs 57 protrude upwardly from the upper sides of the right flanges 52 of the supporting baskets 50 adjacent to the locking holes 55. When the pivoting baskets 60 are seated in the seating spaces 50*s*, sides of the outer ends of the right flanges 52 of the pivoting baskets 60, described later closed contact the outer circumferences of the locking ribs 57.

On the other hand, the left flanges 51 of the supporting baskets 50 adjacent to the hinge holes 54 are formed with supporting ribs 58. Each of the supporting ribs 58 includes a protrusion 58*a* protruded upwardly from a side of the left flange 51, and a support 58*b* extending from the upper end of the protrusion 58*a* to the open longitudinal side of the supporting basket 50.

In this case, each of the protrusion 58*a* is positioned at a position where the pivoting of a later-described hinge bracket 63 is not disturbed, for example, at the upper side of the left flange 51 of the supporting basket 50 adjacent to a track formed by the hinge bracket 63, by the pivoting of the pivoting basket 60 with respect to the supporting basket 50. Each of the supports 58*b* is formed at the protrusion 58*a*. The supports 58*b* extend into the tracks formed by the hinge brackets 63 as the pivoting baskets 60 pivot.

Between the upper sides of the left flanges 51 of the supporting baskets 50 and the lower sides of the supports 58*b*, supporting recesses 59 are formed. Thus, the supporting recesses 59 are opened to face the open longitudinal sides of the supporting baskets 50.

The pivoting baskets 60 have a long rectangular hexahedral shape corresponding to the seating spaces 50*s*. Each of the pivoting baskets 60 has an accommodating space 60*s*. The accommodating space 60*s* is a place where food is accommodated and is formed by an open side of the pivoting basket 60. The pivoting basket 60 pivots within a range from 0 degree to 180 degrees forward and backward the door 30 about belowdescribed hinge pin 64 with respect to the supporting basket 50 from the state of seating in the seating space 50*s*.

Moreover, each of the pivoting baskets 60 includes upper flanges 61 and 62 formed on the lateral upper sides thereof to correspond to the upper flanges 51 and 52 of each of the supporting baskets 50. The upper flanges 61 and 62 of the pivoting baskets 60 extend outwardly from the lateral upper sides of the pivoting baskets 60. When the pivoting baskets 60 seat in the seating spaces 50*s*, the upper flanges 61 and 62 of the pivoting baskets 60 are supported by which the lower sides of the upper flanges 61 and 62 are supported by the upper sides of the corresponding upper flanges 51 and 52 of the supporting baskets 50.

For the illustrative convenience, one of the upper flanges 61 and 62 of the pivoting baskets 60 seen left side in the drawings (hereinafter, referred to as a left flange) includes a hinge bracket 63 formed at the leading end. The hinge bracket 63 extends outwardly from the leading end of the left flange 61 of the pivoting basket 60 and is supported by the upper side of the left flange 51 of the supporting basket 50.

The hinge brackets 63 have an approximate semi-circular shape and an arc-portion of hinge brackets 63 thereof faces left and backward in the drawings. Each of the hinge brackets 63 includes a penetrated cut-off part 63*a*. The penetrated cut-off parts 63*a* prevent the supporting ribs 58 and the hinge brackets 63 from interfering with each other during the insertion of the hinge pins 64 (See FIG. 3) into the hinge holes 54, ie., during the assembly of the door baskets 40.

To this end, the penetrated cut-off parts 63*a* are positioned to correspond to the supporting ribs 58 when the pivoting baskets 60 pivot backward the door 30 by a desired angle about the hinge pins 64 with respect to the supporting baskets 50. For example, when the pivoting baskets 60 pivot backward the door 30 by 180 degrees about the hinge pins 64 with respect to the supporting baskets 50 from the state where the pivoting baskets 60 seat in the seating spaces 50*s*, the penetrated cut-off parts 63*a* may be positioned to correspond to the supporting ribs 58.

The hinge pins 64 are provided at the lower sides of the hinge brackets 63. The hinge pins 64 are inserted into the hinge holes 54 to serve to as pivot centers of the pivoting baskets 60 with respect to the supporting baskets 50. When the hinge pins 64 are inserted into the hinge holes 54, the upper sides of the hinge brackets 63 closely contact the supports 58, substantially the lower sides of the supports 58*b* to be supported. In other words, parts of the hinge brackets 63 are inserted into the supporting recesses 59.

Moreover, each of the upper flanges 62 of the pivoting baskets 60 seen right side in the drawings (hereinafter, referred to as a right flange) includes a locking protrusion 65 formed at the leading lower end. The locking protrusion 65 prevents the pivoting basket 60 from freely pivoting backward the door 30 about the hinge pin 64 with respect to the supporting basket 50 when the pivoting basket 60 seats in the seating space 50*s*.

To this end, the locking protrusions 65 are optionally inserted into the locking holes 55. In other words, when the pivoting baskets 60 seat in the seating spaces 50*s*, the locking protrusions 65 are inserted into the locking holes 55. When the pivoting baskets 60 pivot backward the door 30 about the hinge pins 64 with respect to the supporting baskets 50, the locking protrusions 65 are separated from the locking holes 55. As the locking protrusions 65 are inserted into or separated from the locking holes 55, the right flanges 62 of the pivoting baskets 60 are elastically deformed as a desired degree.

Hereinafter, the assembling operation of the door basket of a refrigerator according to the embodiment of the present invention will be described in detail with reference to the accompanying drawings.

Figure 3:
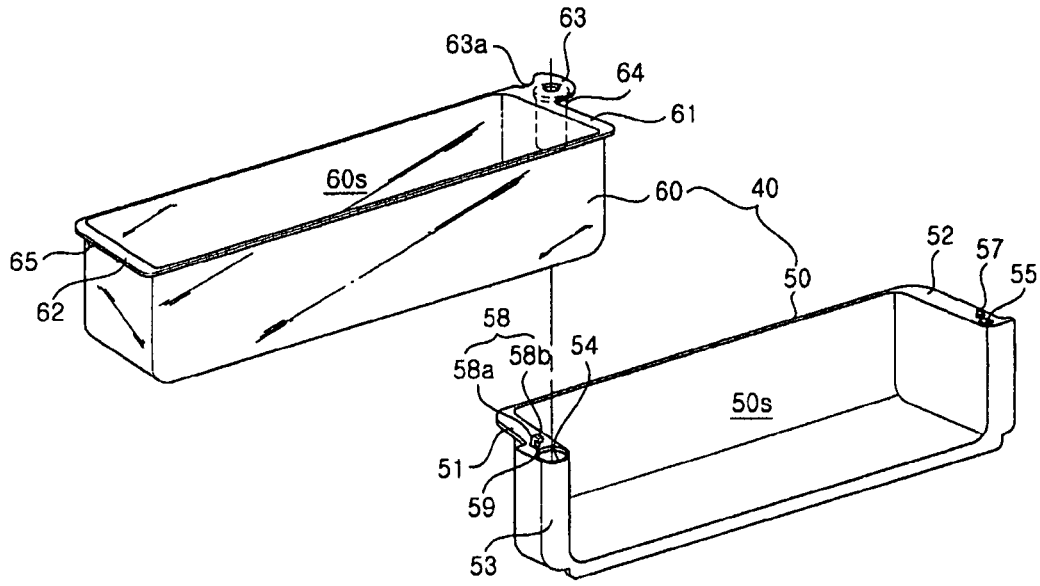
FIGS. 3 to 5 are views illustrating the door basket of a refrigerator according to the embodiment of the present invention.
Figure 4:
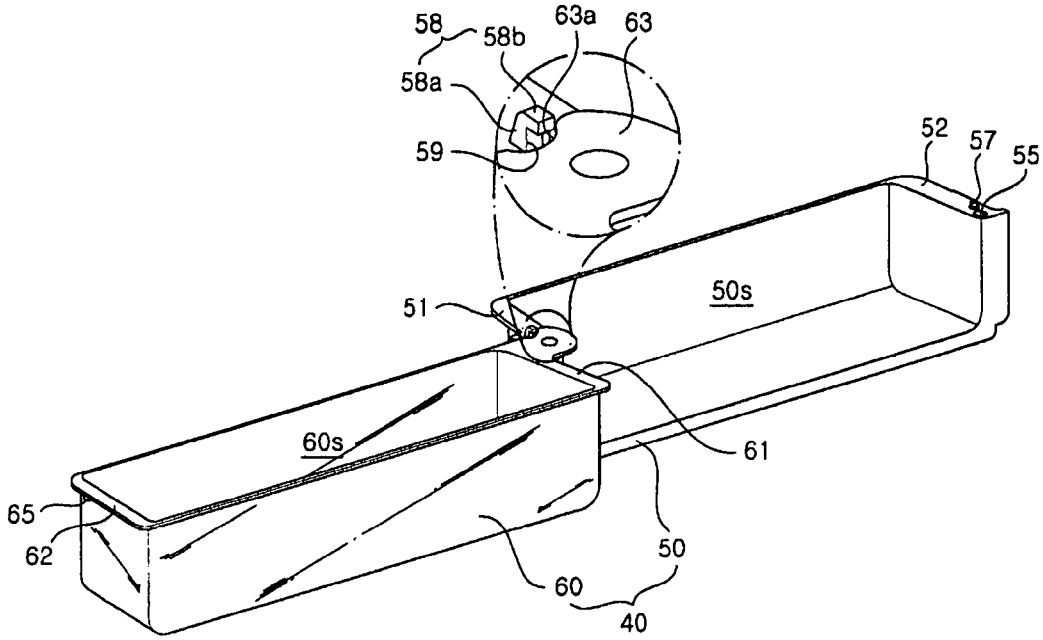
Figure 5:
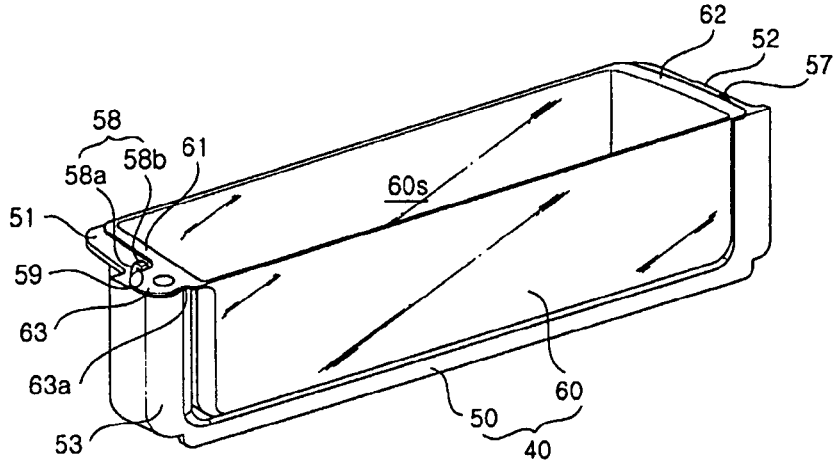

FIGS. 3 to 5 illustrate the door basket of a refrigerator according to the embodiment of the present invention.

Firstly, as illustrated in FIG. 3, the pivoting basket 60 is positioned upper the supporting basket 50. At that time, the hinge pin 64 is positioned directly upper the hinge hole 54 and the penetrated cut-off part 63*a* is positioned directly upper the supporting rib 58. In other words, the pivoting basket 60 is positioned upper the supporting basket to be at a state where the pivoting basket 60 pivots backward the door 30 by 180 degrees about the hinge pin 64 with respect to the supporting basket 50.

Moreover, as illustrated in FIG. 4, the pivoting basket 60 is moved downwardly toward the supporting basket 50. Thus, the hinge pin 64 is inserted into the hinge hole 54. At this time, the supporting rib 58 penetrates the penetrated cut-off part 63*a* so that the interference between the supporting rib 58 and the hinge bracket 63 does not occur.

In this state, the pivoting basket 60 pivots about the hinge pin 54 with respect to the supporting basket 50. Thus, as illustrated in FIG. 5, the pivoting basket 60 seats in the seating space 50*s* and the assembly of the door basket 40 is completed.

Next, operation of accommodating and taking food in and out the door basket according to the embodiment of the present invention will be described in detail with reference to the drawings.

Figure 6:
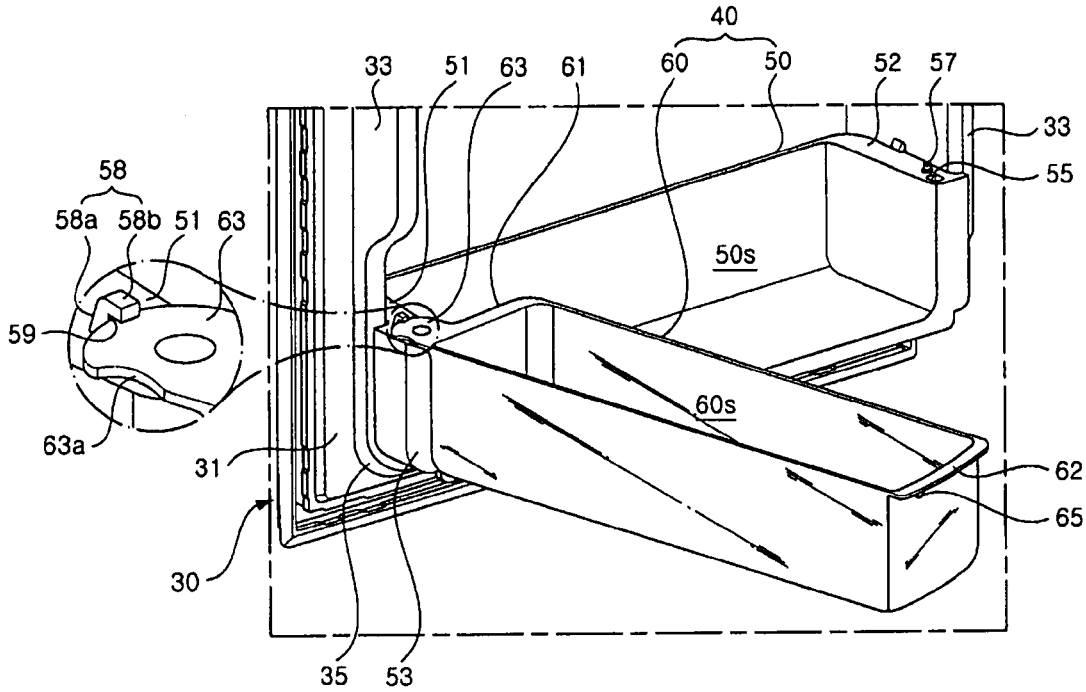
FIGS. 6 and 7 are views illustrating operation of accommodating and taking food in and out the door basket according to the embodiment of the present invention.
Figure 7:
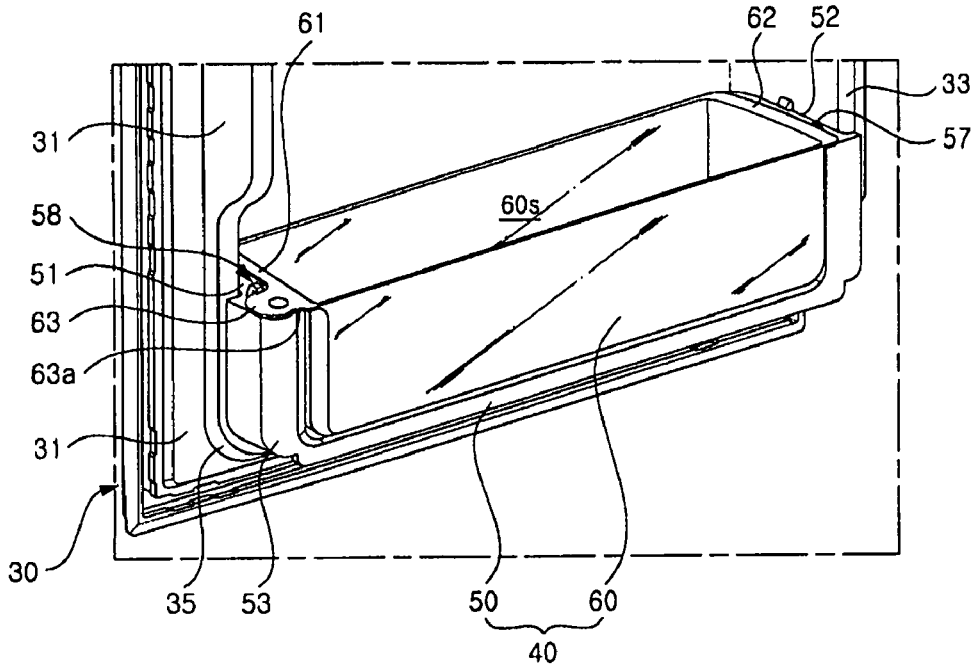

FIGS. 6 and 7 illustrate operation of accommodating and taking food in and out the door basket according to the embodiment of the present invention.

Firstly, in order to accommodate or take food in or out of the accommodating space 60*s*, the pivoting basket 60 pivots backward the door 30 about the hinge pin 64 with respect to the supporting basket 50. At this time, the locking protrusion 65 is released from the insertion into the locking hole 55 and is separated therefrom. Moreover, the outer end side of the right flange 62 of the pivoting basket 60 is released from the close contact with the outer circumference of the locking protrusion 57 to be separated.

Thus, as illustrated in FIG. 6, the pivoting basket 60 is separated from the seating space 50*s* in which the pivoting basket 60 seats, and pivots with respect to the rear surface of the door by a desired angle. Then, a user may put or take food in or out of the accommodating space 60*s*.

As such, the accommodation and taking-out of food is carried out when the pivoting basket 60 is separated from the seating space 50*s*. Thus, even if the upper side of food to be accommodated in or taken out the accommodating space 60*s* is not spaced apart from the lower side of another door basket, positioned directly upper one door basket 40 in which food is accommodated, by a desired distance, that is, as far as the height of the accommodating space 60*s*, food can be accommodated in and taken out of the accommodating space 60*s*. In other words, even food having a height corresponding to the distance between the one door basket 40 and another door basket 40 positioned directly upper the former can be accommodated in and taken out of the accommodating space 60*s*. Moreover, when the pivoting basket 60 is separated from the seating space 50*s*, food is accommodated in or taken out of the accommodating space 60*s* so that the user can easily accommodate and take food in and out of the accommodating space 60*s*.

Furthermore, after food is accommodated in or taken out of the accommodating space 60*s*, the pivoting basket 60 pivots forward the door 30 about the hinge pin 64. Thus, as illustrated in FIG. 7, the pivoting basket 60 seats in the seating space 50*s*. As such, when the pivoting basket 60 seats in the seating space 50*s*, the locking protrusion 65 is inserted into the locking hole 55 and the outer end side of the right flange 62 of the pivoting basket 60 closely contacts the outer circumference of the locking rib 57. Thus, when the pivoting basket 60 seats in the seating space 50*s*, the pivoting basket 60 does not freely pivot backward the door 30 about the hinge pin 64 with respect to the supporting basket 50.

Meanwhile, as the pivoting basket 60 pivots backward the door 30 about the hinge pin 64 with respect to the supporting basket 50, the hinge bracket 63 is inserted into the supporting recess 59 and is supported by the supporting rib 58. Thus, the hinge pin 64 inserted into the hinge hole 54 is not separated from the hinge hole 54. Moreover, it is also possible to prevent a pivoting end of the pivoting basket 60 corresponding to an opposite side of the hinge pin 64 from being deflected from the other end thereof.

As set forth before, the door basket of a refrigerator as embodied and broadly described herein have the following effects.

Firstly, according to the door basket of the present invention, it is possible to accommodate and take food, having a height corresponding to a distance between one door basket and another door basket positioned directly upper the former, in and out of the accommodating space provided in the rear surface of the door of a refrigerator. Thus, the height of food to be accommodated in and taken out is increased, so that the accommodation efficiency of the accommodating space is improved.

Moreover, according to the door basket of the present invention, the pivoting basket having the accommodating space pivots with respect to the supporting basket installed in the rear surface of the door. Thus, since the pivoting basket pivots with the supporting basket and food is accommodated in or taken out of the accommodating space, the user can easily accommodate and take food in and out of the accommodating space.

Furthermore, according to the door basket of the present invention, the pivoting basket is supported by the supporting rib when the hinge bracket is inserted into the supporting recess while the pivoting basket pivots with respect to the supporting basket. Thus, since it is possible to prevent the hinge pin inserted into the hinge hole from being separated from the hinge hole and to minimize the deflection of the pivoting end of the pivoting basket, the reliability of operation is improved and damage of the product can be minimized during the use.

Although an exemplary embodiment of the present invention has been described for illustrative purposes, those skilled in the art will appreciate that various modifications, additions and substitutions are possible, without departing from the scope and spirit of the invention as disclosed in the accompanying claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and appended claims. In addition to variations and modifications in the component parts and/or arrangements, alternative uses will also be apparent to those skilled in the art.

What is claimed is:

1. A door basket of a refrigerator, comprising:

a supporting basket that can be detachably mounted on a door of a refrigerator, wherein the supporting basket has a rectangular hexahedral shape, and wherein the supporting basket has a seating space with an open upper side and a longitudinal open side; and a pivoting basket that is moved into and out of the seating space, wherein one end of the pivoting basket includes a hinge pin having a vertically oriented longitudinal axis, and wherein the hinge pin is pivotally mounted on the supporting basket such that the pivoting basket can pivot about the hinge pin, and wherein the pivoting basket has an accommodating space with an open upper side, wherein the supporting basket comprises a first upper flange extending outwardly from a first upper side of the supporting basket, and wherein a hinge hole is formed in the first upper flange, wherein the pivoting basket comprises a first upper flange extending outwardly from a first upper side of the pivoting basket, wherein the hinge pin extends downward from the first upper flange of the pivoting basket, and wherein the hinge pin is pivotally inserted into the hinge hole.

2. The door basket of a refrigerator as claimed in claim 1, further comprising a supporting device that prevents the pivoting basket from being freely separated from the supporting basket.

3. The door basket of a refrigerator as claimed in claim 2, wherein the supporting device comprises:

a hinge bracket formed on the first upper flange of the pivoting basket and extending outwardly around the hinge pin; and a supporting rib provided on the first upper flange of the supporting basket, wherein the supporting rib supports the hinge bracket during pivoting of the pivoting basket.

4. The door basket of a refrigerator as claimed in claim 3, wherein the supporting rib comprises:

a protrusion protruding upwardly from an upper side of the first upper flange of the supporting basket; and a support extending from the upper side of the protrusion, wherein an outer periphery of the hinge bracket is positioned between an upper side of the first upper flange of the supporting basket and a lower side of the support.

5. The door basket of a refrigerator as claimed in claim 4, wherein an aperture is formed at a side of the hinge bracket to allow the hinge bracket to pass the supporting rib when the hinge pin is inserted into the hinge hole.

6. The door basket of a refrigerator as claimed in claim 5, wherein the pivoting basket pivots approximately 180 degrees away from a position where the pivoting basket is seated in the seating space, and the aperture in the hinge bracket is aligned with the supporting rib when the pivoting basket is pivoted approximately 180 degrees from the position where the pivoting basket seats in the seating space.

7. The door basket of a refrigerator as claimed in claim 6, further comprising a locking device that prevents the pivoting basket from freely pivoting away from the position where the pivoting basket seats in the seating space.

8. The door basket of a refrigerator as claimed in claim 7, wherein the locking device comprises:

a locking hole formed in a second upper flange that extends outwardly from a second upper side of the supporting basket located opposite the first upper flange; and a locking protrusion provided in a second upper flange that extends outwardly from a second upper side of the pivoting basket located opposite the first upper flange, and wherein the locking protrusion is inserted into the locking hole when the pivoting basket seats in the seating space.

9. The door basket of a refrigerator as claimed in claim 8, wherein the locking device further comprises a locking rib provided on an upper side of the second upper flange of the supporting basket, and wherein an outer edge of the second upper flange of the pivoting basket closely contacts the locking rib when the pivoting basket seats in the seating space.

10. The door basket of a refrigerator as claimed in claim 1, further comprising a locking device that prevents the pivoting basket from freely pivoting away from a position where the pivoting basket is seated in the seating space.

11. The door basket of a refrigerator as claimed in claim 10, wherein the locking device comprises:

a locking protrusion formed on a side of the pivoting basket opposite the hinge pin; and a locking hole formed in the supporting basket at a location such that the locking protrusion is received in the locking hole when the pivoting basket is seated in the seating space.

12. A refrigerator comprising the door basket of claim 1.

13. A door basket of a refrigerator, comprising:

a supporting basket that can be mounted on a door of a refrigerator, wherein the supporting basket has a seating space with open upper and front sides; and a pivoting basket having a first side that is pivotally mounted on a first side of the supporting basket such that the pivoting basket can pivot about a vertically oriented rotational axis from a seated position where the pivoting basket is seated in the seating space to an open position, wherein a hinge bracket is provided on the pivoting basket, wherein the hinge bracket extends outward around the rotational axis of the pivoting basket; and a supporting rib is provided on the supporting basket, wherein an aperture of the supporting rib receives a peripheral edge of the hinge bracket, and wherein interaction of the hinge bracket and the supporting rib prevents the pivoting basket from being detached from the supporting basket as the pivoting basket pivots away from the seated position, wherein an aperture is formed in the hinge bracket, and wherein the aperture is located on the hinge bracket such that the aperture is aligned with the supporting rib when the pivoting basket is located at the open position, and wherein the aperture allows the hinge bracket to pass the supporting rib such that the pivoting basket can be detached from the supporting basket when the pivoting basket is located in the open position.

14. The door basket of a refrigerator as claimed in claim 13, wherein the pivoting basket is located in the open position after the pivoting basket has pivoted approximately 180 degrees from the seated position.

15. The door basket of a refrigerator as claimed in claim 13, further comprising a locking device that prevents the pivoting basket from freely pivoting away from the seated position.

16. The door basket of a refrigerator as claimed in claim 15, wherein the locking device comprises:

a locking protrusion formed on a side of the pivoting basket opposite the rotational axis; and a locking hole formed in the supporting basket at a location such that the locking protrusion is received in the locking hole when the pivoting basket moves into the seated position.

17. A refrigerator comprising the door basket of claim 13.

18. A door basket of a refrigerator, comprising:

a housing having an open top and a closed bottom wherein the housing forms a receiving space; and a hinge pin mounted on a first end of the housing, wherein the hinge pin has a vertically oriented longitudinal axis, and wherein the hinge pin is received in a hinge hole located in a first side of a door of a refrigerator such that the housing can pivot about the longitudinal axis of the hinge pin from a seated position where the housing is seated in the door to an open position, wherein a hinge bracket is provided on the housing, wherein the hinge bracket extends outward around the longitudinal axis of the hinge pin, wherein a peripheral edge of the hinge bracket is received in a supporting rib located on the door of the refrigerator, and wherein the interaction of the hinge bracket and the supporting rib prevents the housing from being detached from the door as the housing pivots away from the seated position, wherein an aperture is formed in the hinge bracket, and wherein the aperture is located on the hinge bracket such that the aperture is aligned with the supporting rib when the housing is located at the open position, and wherein the aperture allows the hinge bracket to pass the supporting rib such that the housing can be detached from the door when the housing is located in the open position.

19. The door basket of a refrigerator as claimed in claim 18, further comprising a locking device that prevents the housing from freely pivoting away from the seated position.

20. The door basket of a refrigerator as claimed in claim 19, wherein the locking device comprises a locking protrusion formed on a side of the housing opposite the hinge pin, wherein the locking protrusion is received in a locking hole formed on the door when the housing moves into the seated position.

21. A refrigerator comprising the door basket of claim 18.

22. A door basket of a refrigerator, comprising:

a housing having an open top and a closed bottom wherein the housing forms a receiving space; and a pivotal connecting portion formed on a first end of the housing, wherein the pivotal connecting portion allows the housing to pivot around a vertically oriented rotational axis such that the housing can pivot from a seated position where the housing is seated in the door to an open position, wherein the pivotal connecting portion comprises a hinge pin mounted on one of the housing and the door of the refrigerator and a hinge hole mounted on the other of the housing and the door of the refrigerator, and wherein the hinge pin is received in the hinge hole, wherein a hinge bracket is provided on the housing, wherein the hinge bracket extends outward around the rotational axis, wherein a peripheral edge of the hinge bracket is received in a supporting rib located on the door of the refrigerator, and wherein the interaction of the hinge bracket and the supporting rib prevents the housing from being detached from the door as the housing pivots away from the seated position, wherein an aperture is formed in the hinge bracket, and wherein the aperture is located on the hinge bracket such that the aperture is aligned with the supporting rib when the housing is located at the open position, and wherein the aperture allows the hinge bracket to pass the supporting rib such that the housing can be detached from the door when the housing is located in the open position.

23. The door basket of a refrigerator as claimed in claim 22, further comprising a locking device that prevents the housing from freely pivoting away from the seated position.

24. The door basket of a refrigerator as claimed in claim 23, wherein the locking device comprises a locking protrusion formed on one of the housing and the door of the refrigerator, and a locking hole formed on the other of the housing and the door of the refrigerator, and wherein the locking protrusion is received in the locking hole when the housing moves into the seated position.

25. A refrigerator comprising the door basket of claim 22.

* * * * *